US008001935B2

(12) United States Patent
Haubner et al.

(10) Patent No.: US 8,001,935 B2
(45) Date of Patent: Aug. 23, 2011

(54) CYLINDER HEAD WITH REINFORCEMENT

(75) Inventors: Frank Haubner, Aachen (DE); Mike Souren, Vaals (NL)

(73) Assignee: Fev Motorentechnik GmbH, Aachen (DE)

( * ) Notice: Subject to any disclaimer, the term of this patent is extended or adjusted under 35 U.S.C. 154(b) by 830 days.

(21) Appl. No.: 11/722,780

(22) PCT Filed: Dec. 8, 2005

(86) PCT No.: PCT/EP2005/013152
§ 371 (c)(1),
(2), (4) Date: Mar. 14, 2008

(87) PCT Pub. No.: WO2006/072333
PCT Pub. Date: Jul. 13, 2006

(65) Prior Publication Data

US 2009/0114173 A1 May 7, 2009

(30) Foreign Application Priority Data

Dec. 24, 2004 (DE) ..... 10 2004 062 522

(51) Int. Cl.
*F02F 1/36* (2006.01)

(52) U.S. Cl. ..... 123/41.82 R; 123/193.5

(58) Field of Classification Search ..... 123/41.82 R, 123/193.1, 193.5
See application file for complete search history.

(56) References Cited

FOREIGN PATENT DOCUMENTS

| | | |
|---|---|---|
| EP | 1028246 | 8/2000 |
| EP | 1028247 | 8/2000 |
| JP | 58082045 | 5/1983 |
| JP | 04255554 | 9/1992 |
| JP | 2000104624 | 4/2000 |

*Primary Examiner* — Noah Kamen
(74) *Attorney, Agent, or Firm* — Gifford, Krass, Sprinkle, Anderson & Citkowski, P.C.

(57) ABSTRACT

The invention relates to a cylinder head (1) of an at least one-cylinder internal combustion engine with direction injection of a motor vehicle with a flame deck (2) and with an oil deck (3). An intermediate deck (4) is situated between the flame deck (2) and the oil deck (3), and at least one injector pipe (5) extends from the flame deck (2) up to the oil deck (3). The intermediate deck (4) joins a lower area of an injector pipe (5), particularly an injector dome (6) that is situated approximately centrally in the area of the flame deck (2). When viewing from the flame deck (2), the intermediate deck (4) extends outward in a concave-like manner so that the intermediate deck (4) joins a lateral wall (7) in a range of 40% to 60% of the distance between the flame deck (2) and the oil deck (3).

19 Claims, 2 Drawing Sheets

CYLINDER HEAD WITH REINFORCEMENT

FIELD OF THE INVENTION

The present invention pertains to a cylinder head of an at least 1-cylinder internal combustion engine with direct injection for a motor vehicle.

BACKGROUND OF THE INVENTION

The cylinder heads of multi-cylinder internal combustion engines require sufficient reinforcement in order to permanently withstand the peak pressures occurring during the combustion process. Cylinder heads furthermore need to have sufficient heat dissipation in order to also permanently withstand the thermal stresses. For example, DE 35 46 436 C2 discloses a liquid-cooled cylinder head for a multi-cylinder internal combustion engine. The cylinder head features various supports in order to thusly reinforce channels for valves, bearings, the ignition device, intake channels and exhaust channels arranged in the cylinder head. DE 42 22 801 C2 also discloses a cylinder head for an internal combustion engine, in which an upper and a lower cooling water chamber are completely separated from one another by a partition wall that extends parallel to the bottom of the cylinder head. In addition to separating the two cooling water circuits, the partition wall also serves for reinforcing the cylinder head.

SUMMARY OF THE INVENTION

The present invention is based on the objective of making available a reinforcement for a cylinder head, particularly for high peak pressures, in order to ensure a certain component stability and to permanently withstand high pressure peaks.

This objective is attained with a cylinder head for an at least 1-cylinder internal combustion engine with direct injection. The internal combustion engine can have a flame deck (2) and an oil deck, with an intermediate deck (4) arranged between the flame deck (2) and the oil deck (3). In addition at least one injector pipe (5) extends from the flame deck (2) to the oil deck (3) and the intermediate deck (4) is situated adjacent to a lower region of an injector pipe (5) which is arranged approximately centrally in the region of the flame deck (2). The intermediate deck (4) can extend concavely outward if viewed from the flame deck (2) such that the intermediate deck (4) is connected to a side wall (7) in a region between 40% to 60% of the distance between the flame deck (2) and the oil deck (3). Other advantageous embodiments and additional developments are defined in the dependent claims.

According to the invention, a cylinder head of an at least 1-cylinder internal combustion engine for a motor vehicle, preferably a 4-cylinder internal combustion engine with direct injection, features a flame deck and an oil deck. An intermediate deck is arranged between the flame deck and the oil deck. In addition, at least one injector pipe extends from the oil deck to at least the intermediate deck. The invention furthermore proposes that the intermediate deck be situated adjacent to the injector pipe, preferably adjacent to an injector needle that is arranged approximately centrally in the region of the flame deck. Viewed from the flame deck, the intermediate deck extends concavely outward such that the intermediate deck adjoins a side wall of the cylinder head in a region between 40% and 60% of a distance between the flame deck and the oil deck. The intermediate deck, the flame deck and the oil deck preferably are integrally connected to one another in this case. Due to the concave shape, it is possible to realize a superior reinforcement and, in particular, a greater pressure absorption via the intermediate deck. The concave shape is preferably realized continuously. However, it may also be interrupted by sections that extend approximately plane. It has proved advantageous for the intermediate deck to rise toward the outside from a central region of the cylinder head. This provides an enlarged surface for direct pressure absorption. A curvate shape of the intermediate deck also results in a superior distribution of thermal expansions.

According to one refinement, the intermediate deck is at least partially realized in an arch-shaped fashion and abuts the side wall at least approximately parallel to the flame deck and/or the oil deck. The side wall may extend, for example, perpendicular to the intermediate deck. According to another embodiment, the side wall is inclined such that an angle of less than 90° is formed between the intermediate deck and the side wall. The angle lies, in particular, in a range between 40° and 75°.

According to another embodiment, a water cooling jacket arranged in the cylinder head is divided into two parts, wherein a lower water cooling jacket extends between the flame deck and the intermediate deck and an upper water cooling jacket extends between the oil deck and the intermediate deck. The water cooling jackets may, for example, be completely separated from one another. According to another embodiment, the intermediate deck features at least one opening that connects the lower and the upper water cooling jackets. For example, an opening arranged in the region of the intermediate deck extends parallel to the flame deck and/or oil deck.

An additional improvement in the reinforcement of the cylinder head can be achieved, for example, in that at least two respective ribs that are arranged opposite one another reinforce the flame deck, wherein the ribs extend tangentially from the injector pipe and, in particular, from the injector needle, are tangentially connected to valve guides and transform into threaded pipes of a cylinder head screw connection. The ribs respectively intersect diagonally such that two opposite intersecting regions of the two respective ribs are created. This means that at least four ribs are provided for a cylinder in order to achieve the diagonal bracing. Two respective ribs that are integrally connected only to intake valve guides or only to exhaust valve guides preferably intersect diagonally. This type of rib configuration ensures that lateral forces and torques engaging on the cylinder head do not result in components within the cylinder head changing their position relative to the engine block. In addition, a transverse reinforcement according to the invention allows a superior compensation of thermal expansions in the cylinder head as may occur, for example, when the material heats up at different speeds in a starting phase. It is preferred that the two respective ribs extend beyond the oil deck. The threaded pipes of the cylinder head screw connection are also arranged beyond the oil deck. The oil deck can be stabilized by the ribs in this fashion. In addition, an improved support against torques can be achieved for the elements of the cylinder head that are arranged between the threaded pipes with these ribs that extend beyond the oil deck.

According to a refinement, the two respective ribs transform into the threaded pipes in a region above an oil deck that lies outside the valve spring support. This ensures an unimpaired installation and operation of a valve train. In addition, this makes it possible to machine the valve spring support without simultaneously subjecting the ribs to a machining process. According to another embodiment, the ribs are integrally connected to the intermediate deck. Due to the support of the ribs on the threaded pipes of the cylinder head screw connection on the one hand and on the injector needle or the injector pipe as well as on the valve guides on the other hand, it is possible to absorb the tensions introduced into the concavely shaped intermediate deck and to directly transmit said tensions to the cylinder head screw connection by means of the ribs. In this exemplary manner, a direct flow of forces is achieved from the flame deck into the cylinder head screw connection in the engine block.

It is preferred that the ribs extend outward from the approximately centrally arranged injector needle or the injector pipe, respectively, wherein a first outer rib geometry rises obliquely in the direction of the threaded pipes and the oil deck. The ribs are preferably arranged in a lower region of an injector and extend obliquely upward, wherein the ribs are connected to the threaded pipes in a region of the oil deck. The injector region is stabilized, in particular, against the pressure exerted by a combustion chamber of the cylinder in this fashion. According to a refinement, a second outer rib geometry features a smaller rise than the first outer rib geometry before the transition into the threaded pipes such that the rib is extended if viewed in a longitudinal section. This results in an elongated connecting surface between the rib and the threaded pipe. Consequently, the tensions in the rib can be transmitted over a larger surface such that the stresses are reduced.

The cylinder head is preferably manufactured of an aluminum material, wherein the cylinder head forms part of an internal combustion engine that operates in accordance with the Diesel principle. In addition to an aluminum alloy, it is also possible to use another casting material, for example, a magnesium alloy, graphite cast iron, particularly vermicular graphic cast iron (CGI). A proposed cylinder is able, in particular, to permanently withstand peak pressures in excess of 200 bar. One advantageous application of a cylinder head is in motor vehicles, in particular, with a peak pressure in excess of 180 bar, for example, an inline 6-cylinder Diesel engine.

BRIEF DESCRIPTION OF THE DRAWINGS

Other embodiments are illustrated in the figures. The exemplary characteristics illustrated in the individual figures are, however, not limited to these embodiments. On the contrary, these characteristics may be combined into other embodiments together with other characteristics of other figures or with characteristics of the preceding description. The figures show.

DETAILED DESCRIPTION OF THE PREFERRED EMBODIMENTS

Figure 1:
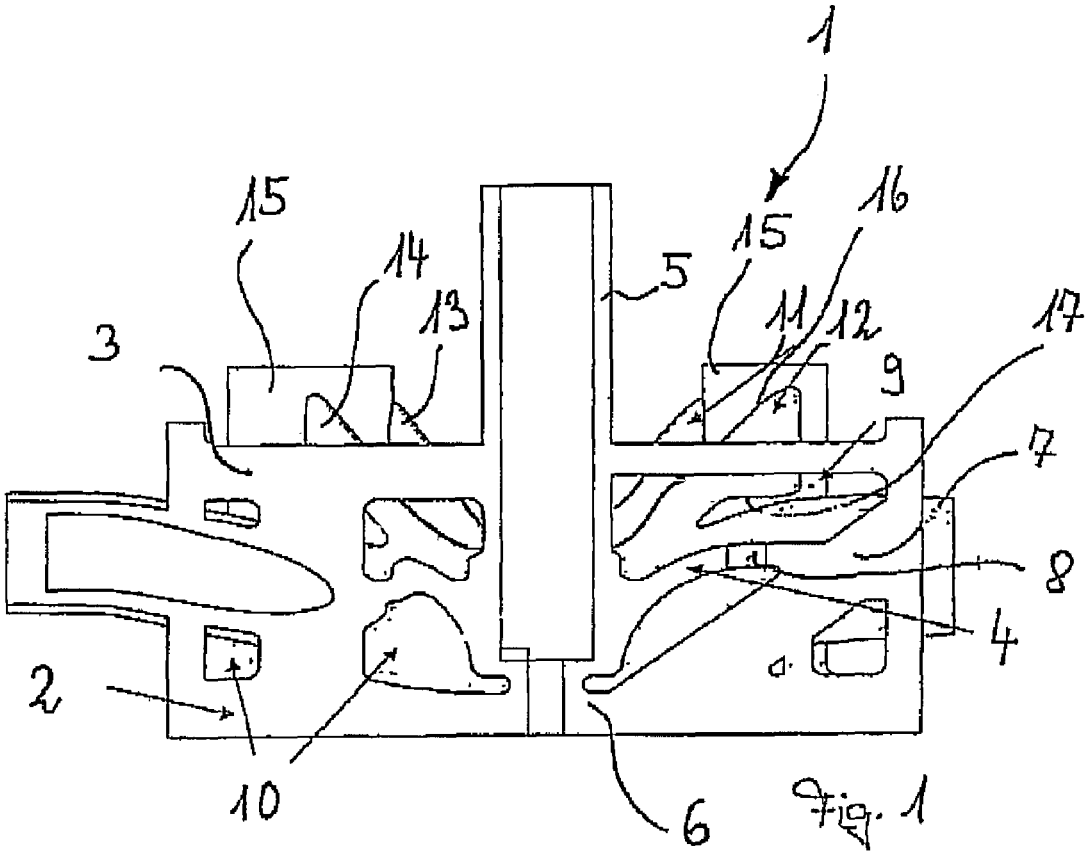
FIG. 1, a cross-section through an exemplary cylinder head.

FIG. 1 shows a cross section through a first cylinder head 1. The cylinder head 1 features a flame deck 2 as well as an oil deck 3. An intermediate deck 4 of concave shape is arranged between the flame deck 2 and the oil deck 3. The intermediate deck 4 is integrally connected to an injector pipe 5. An injection device as well as an ignition device that are not illustrated in detail may be provided in the injector pipe 5. The injector pipe 5 forms an injector needle 6 in its lower region. The intermediate deck 4 is preferably connected to the lower region of the injector pipe 5 and therefore to the injector needle 6. A constriction is preferably provided in the region of the injector pipe 5. The constriction is provided, for example, at least in a lower region of the injector pipe. The constriction makes it possible for cooling water to be admitted into the constriction. The constriction is preferably arranged in a region in which the injector pipe 5 forms the injector needle 6 as shown. The cooling water jacket region is realized at this location, in particular, such that it extends into the constriction along the flame deck 2 as far as the injector needle 6. In this case, this cooling water jacket region preferably features an opening that extends approximately perpendicular to the flame deck 2 and leads to the cooling water jacket region situated on top thereof. The intermediate deck 4 transforms into a side wall 7. The side wall 7 is realized, for example, in the form of a bracing. This bracing therefore extends at an incline in the cylinder head 1. Consequently, the intermediate deck 4 transforms into the side wall 7 at an angle other than 90° on the opposite end referred to the injector pipe 5. The side wall may preferably form part of a core of a spark plug. The intermediate deck 4 may also transform into an element that fulfills a different function than that of a wall in the cylinder head. The intermediate deck 4 may feature one or more openings 8. An upper water jacket 9 can be connected to a lower water jacket 10 via the openings 8. The cross section through the cylinder head 1 also shows a first rib 11 and a second rib 12, as well as a third rib 13 and a fourth rib 14. The ribs 11 through 14 are connected to the centrally arranged injector pipe 5, particularly to the injector needle 6 or the lower region of the injector pipe 5. On the opposite end, the ribs 11 through 14 integrally extend into threaded pipes 15, through which the cylinder head screw connection extends, The threaded pipes 15 extend beyond the oil deck 3 in this case. This means that the ribs 11 through 14 also may at least partially extend beyond the oil deck 3 in the region of the transition into the threaded pipes 15. The second rib 12, for example, has a first outer rib geometry 16. This first outer rib geometry extends from the injector pipe 5 to the threaded pipe 15 in an ascending fashion.

A second outer rib geometry 17 is arranged opposite the first outer rib geometry 16 and also features an ascending section, for example, in a first region. However, the ascending angle decreases in an adjacent second region. The second outer rib geometry 17 extends, in particular, approximately parallel to the oil deck 3 in the second region. The second rib 12 is extended in this fashion such that a larger surface is available for the transition from the rib into the threaded pipe 15. The reinforcement can be additionally improved in this fashion. The shape of the rib can furthermore be influenced, for example, by the progression of the water jacket.

Figure 2:
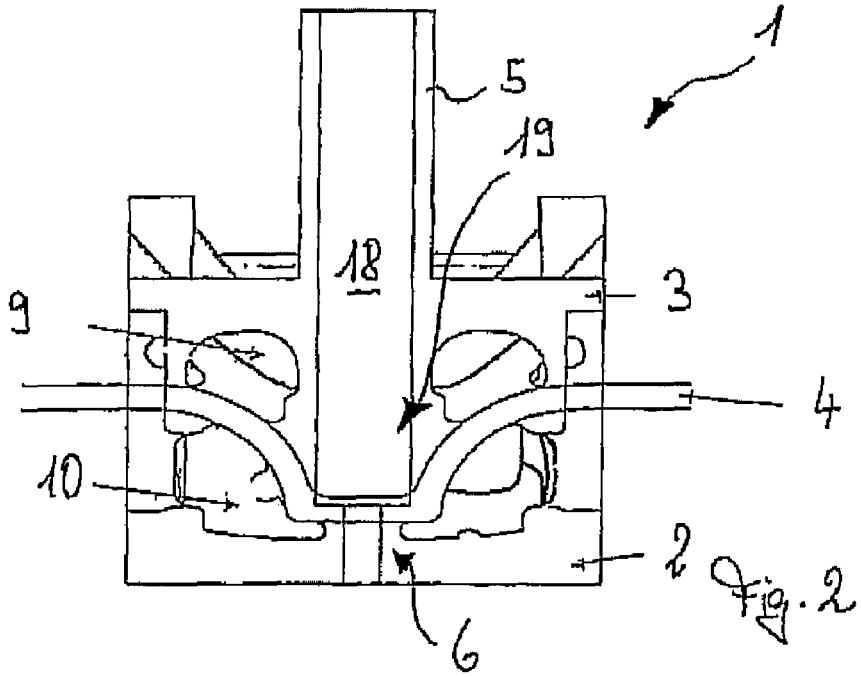
FIG. 2, a longitudinal section through the cylinder head according to FIGS. 1.

FIG. 2 shows the cylinder head 1 according to FIG. 1 in the form of a longitudinal section. The intermediate deck 4 is schematically indicated and illustrated in this figure. It once again separates the upper water jacket 9 from the lower water jacket 10. The schematic longitudinal section shows that the intermediate deck 4 is connected in the lower region of the injector pipe 5 and therefore practically to the injector needle 6. The injector pipe 5 preferably may extend with its recess 18 at least partially into the material of the intermediate deck 4. The intermediate deck 4 may form, in particular, a plate region 19, in the center of which the injector pipe 5 is arranged. FIG. 2 also shows that the intermediate deck 4 that originates at the injector pipe 5 transforms into a side wall in an outer region of the cylinder head 1, wherein this transition is arranged at a height that amounts to 40% to 60% of the distance between the flame deck 2 and the oil deck 3. The intermediate deck 4, in particular, is neither connected to the flame deck 2 nor the oil deck 3. On the contrary, the intermediate deck 4 is arranged in the cylinder head 1 separately from the flame deck 2 and the oil deck 3.

Figure 3:
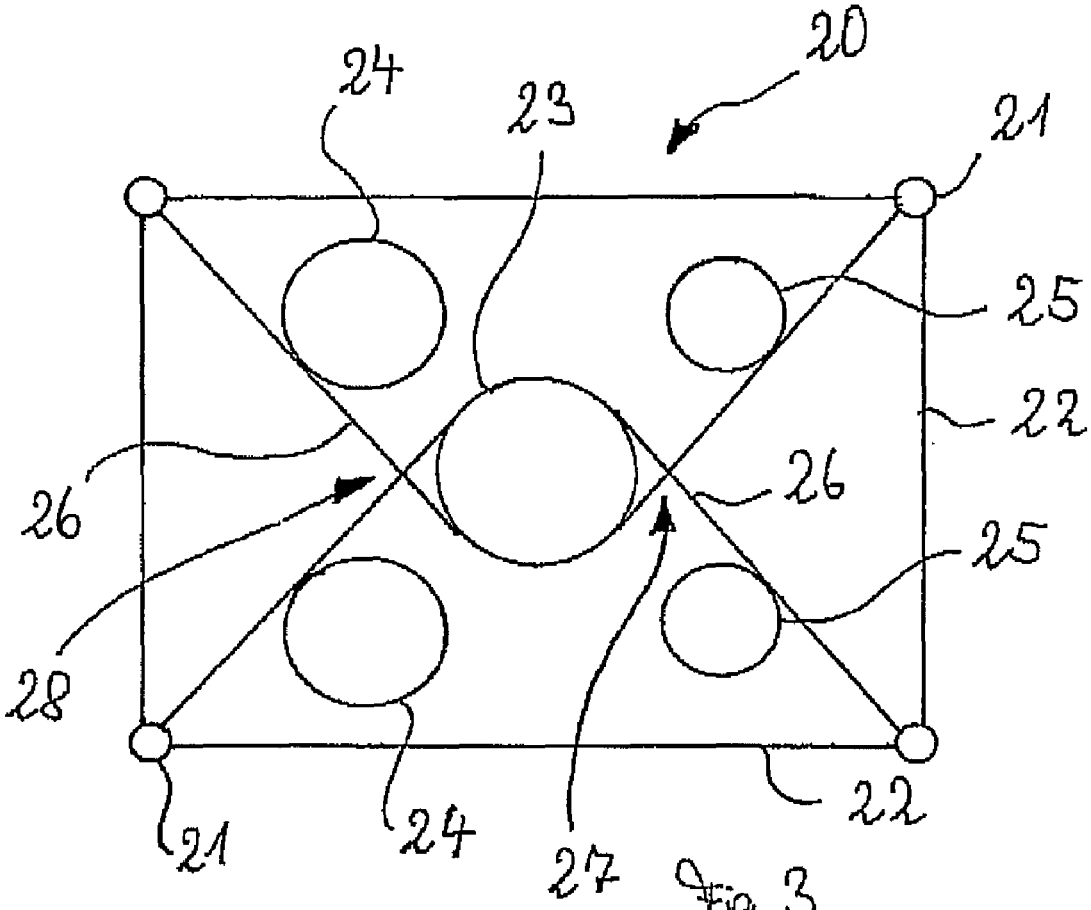
FIG. 3, a top view of an exemplary embodiment of ribs in an inventive cylinder head.

FIG. 3 shows a schematic representation of a second cylinder head 20. This figure shows four threaded pipes 21 that are connected to one another by means of side walls 22. An injector pipe 23 is centrally arranged in this section of the second cylinder head 20. In addition, intake valve guides 24 and exhaust valve guides 25 are provided. The valve guides 24, 25 as well as the injector pipes 23 are integrally connected to the threaded pipes 21 by means of four ribs 26. Two respective ribs 26 intersect diagonally and therefore form a first intersecting region 27 and a second intersecting region 28. The two intersecting regions 27, 28 lie opposite one another and are separated by the injector pipe 23. The ribs 26 are tangentially connected to the injector pipe 23. This applies analogously to the connection to the valve guides 24, 25. In this case, the valve guides 24, 25 may be arranged in such a way that the ribs 26 extend at least largely straight. However, they may also be arranged offset to one another in such a way that the respective ribs 26 are sectionally plane, wherein these sections are arranged relative to one another at an angle that is dependent on the position of the valve guides 24, 25 and the threaded pipes 21 with the injector pipe 23. Due to the tangential connection of the ribs, it is possible to utilize the particular reinforcement of the valve guides for stabilizing the not-shown water jackets and the installations provided therefor.

Figure 4:
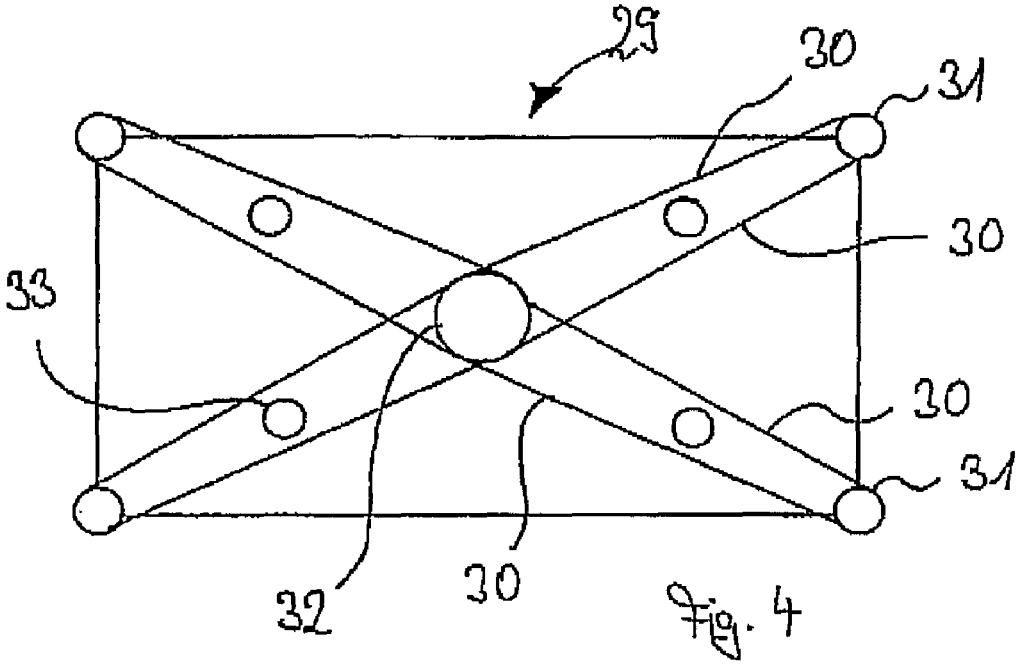
FIG. 4, a top view of an exemplary embodiment dribs in an inventive cylinder head.

FIG. 4 shows a schematic representation of a third cylinder head 29. In this case, ribs 30 extend from the threaded pipes 31 to an injector 32, wherein the ribs are connected to the threaded pipes 31 and/or the injector 32 in an at least approximately tangential fashion. Deviations may occur, for example, because of casting technology such that the ribs 30, in particular, do not intersect in the vicinity of the injector 32. In this schematic embodiment of the cylinder head 29, the ribs 30 are not connected to, but rather extend past the valve pipes 33.

The invention claimed is:

1. A cylinder head (1) of an at least 1-cylinder internal combustion engine of a motor vehicle, adapted for use in an internal combustion engine with direct injection, with a flame deck (2) and an oil deck, wherein an intermediate deck (4) is arranged between the flame deck (2) and the oil deck (3), wherein at least one injector pipe (5) extends from the flame deck (2) to the oil deck (3), characterized by the fact that the intermediate deck (4) is situated adjacent to a lower region of an injector pipe (5) which is arranged approximately centrally in the region of the flame deck (2), and by the fact that the intermediate deck (4) extends concavely outward if viewed from the flame deck (2) such that the intermediate deck (4) is connected to a side wall (7) in a region between 40% to 60% of the distance between the flame deck (2) and the oil deck (3) and is at least partially realized in an arch-shaped fashion and abuts the sidewall (7) at least approximately parallel to the flame deck (2) and/or the oil deck (3).

2. The cylinder head (1) according to claim 1, characterized by the fact that the intermediate deck (4) is arranged between a water jacket that is divided into two parts, wherein a lower water jacket (10) extends between the flame deck (2) and the intermediate deck (4) and an upper water jacket (9) extends between the oil deck (3) and the intermediate deck (4).

3. The cylinder head (1) according to claim 1, characterized by the fact that the intermediate deck (4) features at least one opening (8) that connects the lower (10) and the upper (9) water jackets to one another.

4. The cylinder head (1) according to claim 3, characterized by the fact that the opening (8) is cast.

5. The cylinder head (1) according to claim 4, characterized by the fact that at least one other opening is produced by means of machining.

6. The cylinder head (1) according to claim 1, characterized by the fact that at least two respective opposite ribs (11, 12) reinforce the flame deck (2) and extend tangentially outward from the injector pipe (5), wherein said ribs are tangentially connected to the valve guides (24, 25) and transform into threaded pipes (15) of a cylinder head screw connection, and wherein the ribs (11, 12) respectively intersect diagonally such that two opposite intersecting regions (27, 28) are formed.

7. The cylinder head (1) according to claim 6, characterized by the fact that the ribs (11, 12) are integrally connected to the intermediate deck (4).

8. The cylinder head (1) according to claim 6, characterized by the fact that the ribs (11, 12) extend outward from the about centrally arranged injector pipe (5), wherein a first outer rib geometry (16) ascends obliquely in the direction of the threaded pipe (15).

9. The cylinder head (1) according to claim 8, characterized by the fact that a second outer rib geometry (17) ascends at a smaller angle before the transition into the threaded pipe (15) such that at least one rib is elongated if viewed in the longitudinal direction.

10. The cylinder head (1) according to claim 1, characterized by the fact that two respective ribs (11, 12) extend beyond the oil deck (3) in order to reinforce the cylinder head (1).

11. The cylinder head (1) according to claim 1, characterized by the fact that two respective ribs (11, 12) transform into threaded pipes (15) in a region above an oil deck (3), wherein said region lies outside a valve spring support.

12. The cylinder head (1) according to claim 1, characterized by the fact that ribs (11, 12) are arranged in a lower region of an injector and extend obliquely upward, wherein the ribs (11, 12) are connected to the threaded pipes (15) in a region of the oil deck (3).

13. The cylinder head (1) according to claim 1, further comprising a diesel internal combustion engine with the cylinder head (1).

14. The cylinder head according to claim 1, characterized in that the diesel internal combustion engine operates with a peak pressure in excess of 180 bar.

15. A cylinder head (1) of an at least 1-cylinder internal combustion engine of a motor vehicle, adapted for use in an internal combustion engine with direct injection, with a flame deck (2) and an oil deck, wherein an intermediate deck (4) is arranged between the flame deck (2) and the oil deck (3), wherein at least one injector pipe (5) extends from the flame deck (2) to the oil deck (3), characterized by the fact that the intermediate deck (4) is situated adjacent to a lower region of an injector pipe (5) which is arranged approximately centrally in the region of the flame deck (2), and by the fact that the intermediate deck (4) extends concavely outward if viewed from the flame deck (2) such that the intermediate deck (4) is connected to a side wall (7) in a region between 40% to 60% of the distance between the flame deck (2) and the oil deck (3) and two respective ribs (11, 12) transform into threaded pipes (15) in a region above an oil deck (3), wherein said region lies outside a valve spring support.

16. The cylinder head (1) according to claim 15, characterized by the fact that the intermediate deck (4) is arranged between a water jacket that is divided into two parts, wherein a lower water jacket (10) extends between the flame deck (2)

and the intermediate deck (4) and an upper water jacket (9) extends between the oil deck (3) and the intermediate deck (4).

17. The cylinder head (1) according to claim 15, characterized by the fact that the intermediate deck (4) features at least one opening (8) that connects the lower (10) and the upper (9) water jackets to one another.

18. The cylinder head (1) according to claim 17, characterized by the fact that the opening (8) is cast.

19. The cylinder head (1) according to claim 18, characterized by the fact that at least one other opening is produced by means of machining.

* * * * *